US005342053A

United States Patent [19]

Smith

[11] Patent Number: 5,342,053

[45] Date of Patent: Aug. 30, 1994

[54] GOLF PUTTING APPARATUS

[76] Inventor: Clinton L. Smith, R.R. 2, Box 172-14, Ozark, Mo. 65721

[21] Appl. No.: 152,685

[22] Filed: Nov. 16, 1993

[51] Int. Cl.[5] ..... A63B 69/36

[52] U.S. Cl. ..... 273/185 R; 273/179 R

[58] Field of Search ..... 273/184 R, 184 A, 184 B, 273/185 R, 185 A, 185 B, 179 R, 179 A, 179 B, 182 R, 182 A, 176 F, 176 FA, 176 FB

[56] References Cited

U.S. PATENT DOCUMENTS

| | | | |
|---|---|---|---|
| 3,575,559 | 4/1971 | Tierney | 273/184 X |
| 4,180,726 | 12/1979 | De Crescent | 250/222 R |
| 4,872,687 | 10/1989 | Dooley | 273/185 R |
| 5,067,718 | 11/1991 | Knox et al. | 273/185 R |

*Primary Examiner*—William H. Grieb

*Attorney, Agent, or Firm*—Kokjer, Kircher, Bowman & Johnson

[57] ABSTRACT

Golf putting apparatus useful for practice and amusement. Golf balls are putted along a path toward a target zone. The width of the path is resolved into segments which define the target zone, bogey zones on opposite sides of the target zone, and multiple bogey zones outside of the bogey zones. The size of the target zone is varied from cycle to cycle to provide holes with different par values. A bonus zone in the center area of the target zone allows birdie and eagle scores to be achieved when a selected number of consecutive putts are made in the bonus zone. Each segment within the target zone is assigned a maximum allowable speed which increases toward the target zone center. Even if a putt is within the target zone, it is considered a miss if the maximum allowable speed for the putt location is exceeded.

21 Claims, 6 Drawing Sheets

GOLF PUTTING APPARATUS

FIELD OF THE INVENTION

This invention relates generally to a golf putting machine which is useful for practice and/or amusement. More specifically, the invention is directed to improvements in a machine of the type disclosed in U.S. Pat. No. 5,067,718.

BACKGROUND OF THE INVENTION

U.S. Pat. No. 5,067,718 to Knox et al. Discloses a golf putting device which is equipped to measure both the speed and position of a golf ball patted toward a target. While this device has a number of attractive features, there are some aspects of the game of golf that it does not closely simulate. For example, while the electronics is able to detect the location of each patted ball and determine whether it is on target or to the left or right, there is no provision made for assigning specific areas as bogey zones, double bogey zones or triple bogey zones. Likewise, there is no provision made for a bonus for an under par score such as a birdie or eagle.

In the apparatus disclosed in the Knox et al. patent, all putts that are located anywhere within the cup or target area are considered to be made, so long as they are below a particular speed. In the actual game of golf, putts having one speed may enter the cup if they are at or close to its center, while other putts at the same or even lower speeds may "rim out" if they are located closer to the edge of the cup. Thus, if actual putting is to be simulated realistically, the maximum allowable speed for a putt to be considered made should vary depending upon its location relative to the center of the target area.

SUMMARY OF THE INVENTION

The present invention provides a number of improvements in a machine of the type described in U.S. Pat. No. 5,067,718. In one aspect, the apparatus of the present invention provides bogey and multiple bogey zones which are located outside of the target or cup zone. The bogey zones are closest to the opposite sides of the cup, while the multiple bogey zones are farther from the target to reflect increased penalties for putts that are farther off line.

Another feature of the present invention is that each different cycle of the machine (representing a different hole) provides a target or cup zone that varies in size. This feature allows the device to function more realistically because relatively large holes are considered as par three holes, relatively small holes are considered as par five holes, and medium sized holes are considered as par four holes.

In accordance with another aspect of the invention, it is possible to achieve birdie and eagle scores as bonuses when merited by particularly accurate putts. To achieve a birdie score, it is necessary to putt a selected number of consecutive balls within a small bonus zone that is located at the center of each target area. An eagle score can be achieved with a greater number of consecutive putts in the bonus zone. To reflect the fact that under par scores are more common on holes with higher pars assigned to them, a greater number of consecutive putts is required to achieve a bonus score on a par three hole than on a par four hole or par five hole.

The invention is further characterized by a scheme that, in determining whether a putt is made or missed, takes into account the ball speed compared to its location within the cup area. Each segment across the width of the target area is assigned a maximum allowable ball speed which increases from the opposite sides of the target zone toward the center. A putt is considered to be a miss even though it is within the target area if it exceeds the maximum allowable speed for the part of the target zone it enters. In this way, the machine reflects realistically which putts would be made and which would be missed in actual putting.

"Pressure putt" conditions are also simulated by providing both visual indications and audible announcements of upcoming putts that are potential birdies or eagles. Realistic indications of how far each missed putt would roll past the hole are given, and provisions are made to enhance the accuracy of these distances by accommodating entry of the speed conditions of the surface along which the putts are made.

These features are combined with an attractive and informative visual display and with audio enhancements to provide a golf putting machine that closely simulates actual putting and generates scores which closely reflect the accuracy of putted balls, both as to their locations and speeds. The machine also has the capability of averaging the scores for three consecutive rounds to provide players with an average of "handicap" score indicative of their performance.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
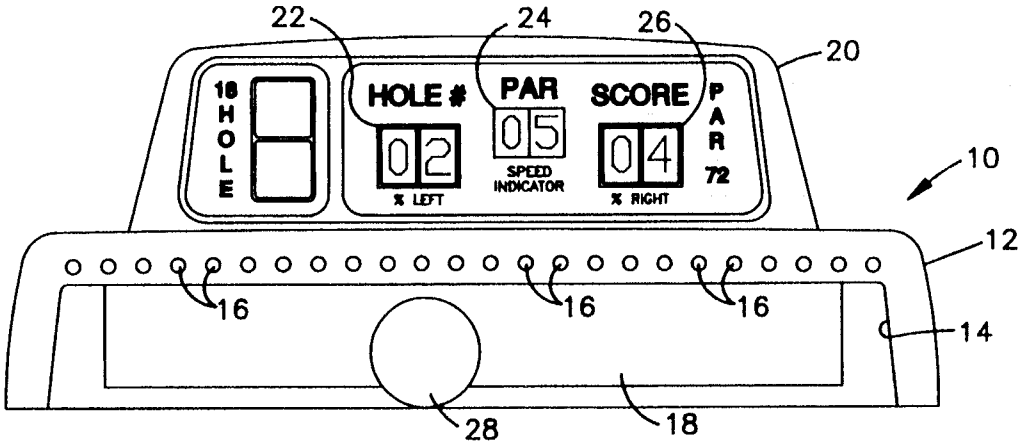
FIG. 1 is a front elevation view of a golf putting apparatus constructed according to a preferred embodiment of the present invention, with a golf ball shown as it enters the target area of the machine.

Referring now to the drawings in more detail and initially to FIG. 1, a golf putting machine constructed in accordance with a preferred embodiment of the present invention is generally identified by numeral 10. The machine 10 is constructed in the manner described in detail in U.S. Pat. No. 5,067,718 which issued on Nov. 26, 1991 to Knox et al. And which is incorporated herein by reference. The details of the machine construction, general electronics, measurement of the speed and position of putted balls, and ball return mechanism are described in detail in the Knox et al. patent.

The machine 10 takes the form of an amusement game that also provides putting practice in order to improve putting performance. The present invention is directed to the provision of features that allow the game to more realistically simulate actual putting so that its value is enhanced both for amusement purposes and for providing feedback that is helpful for practice purposes.

The machine 10 has a hollow shell 12 which may have a molded plastic construction. On the front of the shell 12, an opening 14 is provided for the receipt of incoming putted balls. The opening 14 extends across nearly the entire width of the shell 12 and has a height greater than the diameter of a standard golf ball (1.68 inches). The width of opening 14 may be approximately 12 inches. The shell 12 may rest on a suitable flat supporting surface, or the bottom of the shell may be provided with a floor if desired.

When the machine is used, golf balls are putted toward the shell 12 along a path which leads to the opening 14 and preferably has a width equal to that of the opening 14. The path may take the form of a carpet or other suitable surface which may be provided as part of the machine 10 or separately. In either case, the path may have virtually any desired length.

On the front face of the shell 12, a plurality of LEDS 16 are spaced apart in a horizontal row located above the opening 14. The LADS 16 are spaced equally apart from one another, as will be explained in more detail. A paddle 18 is mounted within the shell 12 and forms part of a ball return mechanism that is described fully in the Knox et al. patent.

A display panel 20 may be mounted on the shell 12. The face of the panel 20 has on its left side portion a two digit display 22. A "hole number" indication is located above the display 22, and a "percent left" indication is located below the display 22. A center display 24 also includes two digits. Above it, a "par" indication is located. A "speed indicator" notation is located below the display 24. On the right hand side of the panel 20, a third two digit display 26 is provided. A "score" indication is located above display 26, while a "percent right" indication is located below display 26.

Figure 2:
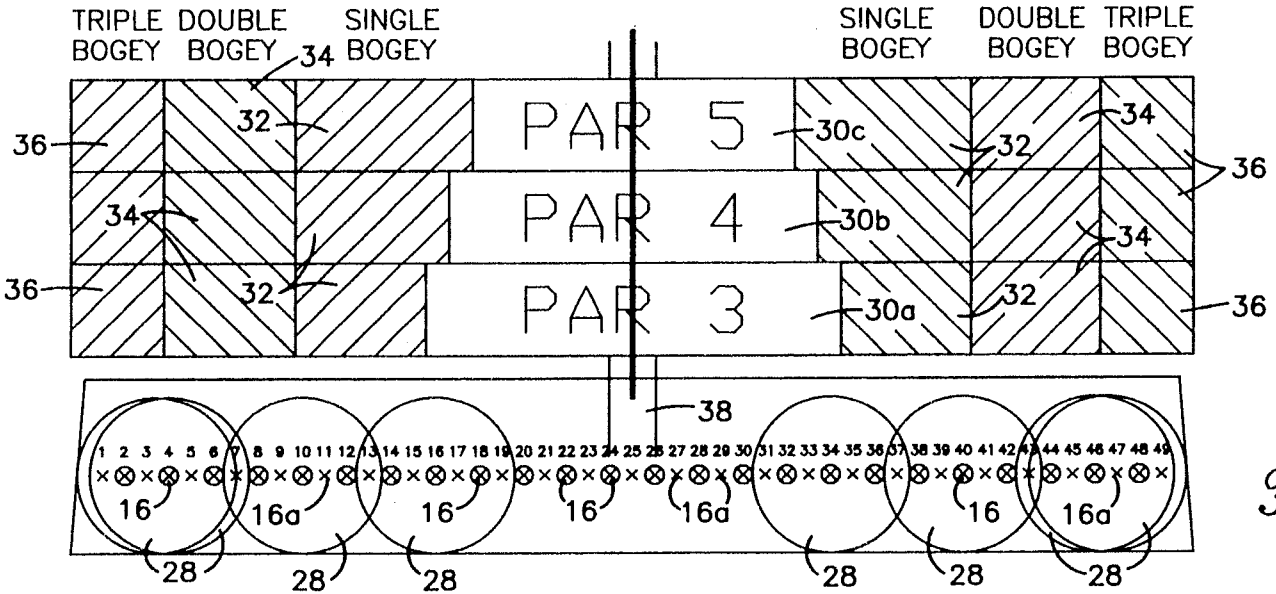
FIG. 2 is a diagrammatic plan view depicting the target zones, bogey zones and bonus zone, along with the segments into which the width of the ball receiving opening is resolved.

Referring now more particularly to FIG. 2, the LEDs 16 are spaced apart from one another a uniform distance of approximate 0.47 inch across the width of opening 14. There are imaginary points of resolution 16a which are located midway between adjacent pairs of the LEDs 16. There may be a total of 24 LEDs 16 and a total of 25 imaginary points of resolution 16*a*, with the two points 16*a* on the ends located approximately 0.235 inch from the adjacent end LEDs. The LEDs 16 and the points 16*a* together resolve the width of the opening 14 into a total of 49 points of resolution which are spaced equidistantly across the width of the opening. The width of the opening 14 is thus resolved into 50 segments which extend between the LEDs 16 and the points 16*a*, with each of the segments having a length of approximately 0.235 inch.

As explained in U.S. Pat. No. 5,067,718, the speed and location of the center of a golf ball, such as one of the balls 28, are detected by the machine as the ball rolls into the opening 14. The machine detects which of the segments coincides with the center line of the ball 28. If the ball center line is closest to one of the LEDs 16, that LED and the two LEDs adjacent to it are energized to indicate the ball position. If the center line is closer to one of the points 16*a* than to an LED, four LEDs are energized, the two LEDs on opposite sides of the point 16*a* closest to the ball center line and the two adjacent LEDs.

For each different "hole" or cycle of the machine, selected LEDs 16 are energized to indicate a target zone representing a golf cup at which the ball 28 is aimed when putted toward the opening 14. The target zones vary both in width and location from cycle to cycle. For example, as shown in FIG. 2, a target zone 30*a* which represents a par 3 hole may have a width of approximately 4.25 inches which represents 19 different points of resolution (18 segments) and encompassing ten LEDs which are all energized to identify the size and location of the target zone 30*a*. The target zone 30*b* represents a par four hole, and its diameter may be about 3.78 inches and include 17 points of resolution (16 segments) and encompass nine LEDs which are energized to display the size and location of the target zone 30*b*. Finally, the smaller target zone 30*c* representing a par five hole may be 3.31 inches wide and include 15 points of resolution (14 segments) and encompass eight LEDs which are energized to identify the size and location of the target zone 30*c*.

A pair of bogey zones 32 are provided at locations adjacent to and on opposite sides of each of the target zones. For each hole, the two bogey zones 32 are equal in width. However, the bogey zones 32 for par three holes are narrower than those for par four holes, and the bogey zones 32 for the par four holes are narrower than those for the par five holes. By way of example, bogey zones 32 for the par three holes may be approximately six segments wide, those for par four holes may be approximately seven segments wide, and the bogey zones for par five holes may be approximately eight segments wide.

Double bogey zones 34 are presented on the outside of each of the single bogey zones 32. The double bogey zones 34 may be identical in width for all holes and may normally be six segments wide. There are also triple bogey zones 36 provided. Each of the triple bogey zones 36 extends from the adjacent double bogey zone 34 to the edge of the opening 14. When the target zone is centered on the opening 14, the triple bogey zones may each be approximately four segments wide.

Although each of the target zones 30*a*, 30*b* and 30*c* is depicted in FIG. 2 as being centered across the width of opening 14, the target zones are shifted to the left and to the right during different cycles of the machine. For example, on one hole there may be a par three target zone 30*a* centered at resolution point 21 and on the next hole there may be a par four target zone 30*b* centered on resolution point number 34. The following Table 1 provides an example of an 18 hole course "layout", with the handicap numbers representing relative degree of difficulty in the usual way the holes are rated on golf courses and the resolution numbers in the last column of the table correlating with the resolution point numbers on FIG. 2:

TABLE 1

| HOLE # | PAR # | HANDICAP # | CENTERLINE @ RESOLUTION # |
|---|---|---|---|
| 1 | 4 | 8 | 30 |
| 2 | 5 | 10 | 23 |
| 3 | 4 | 12 | 22 |
| 4 | 4 | 16 | 24 |
| 5 | 3 | 14 | 33 |

TABLE 1-continued

| HOLE # | PAR # | HANDICAP # | CENTERLINE @ RESOLUTION # |
|---|---|---|---|
| 6 | 5 | 2 | 19 |
| 7 | 3 | 18 | 25 |
| 8 | 4 | 6 | 32 |
| 9 | 4 | 4 | 34 |
| 10 | 4 | 7 | 18 |
| 11 | 4 | 5 | 16 |
| 12 | 3 | 17 | 29 |
| 13 | 4 | 9 | 20 |
| 14 | 5 | 1 | 31 |
| 15 | 4 | 13 | 26 |
| 16 | 4 | 11 | 28 |
| 17 | 3 | 15 | 21 |
| 18 | 5 | 3 | 27 |

It should be noted that as the target zones move to the left and right, the single bogey zones 32, double bogey zones 34 and triple bogey zones 36 move the same distance in the same direction. If the target zone moves to the left of the centered position, the triple bogey zone on the left side becomes narrower than depicted in FIG. 2, and the triple bogey zone on the right side becomes wider by a corresponding amount. If the target zone is shifted far enough to the left that the double bogey zone 34 on the left side must be decreased in width, the double bogey zone 34 on the right side does not change in width but the triple bogey zone 36 on the right side increases in width by the amount of the decrease in the double bogey zone on the left side of the machine. An effect opposite to that just described takes place when the target zone moves to the right of the centered position.

With continued reference to FIG. 2, a bonus zone 38 is defined at the center of each target zone. The bonus zone 38 is three points of resolution or two segments wide and is always symmetrical about the center line of the target zone, regardless of the target zone size or position with respect to the width of the opening 14. The machine detects each time a ball is putted into opening 14 with the ball center line located within the bonus zone 38. Bonus scores representative of birdies and eagles can be achieved by putting a predetermined number of consecutive balls whose center lines are located within the bonus zone 38. The number of consecutive bonus shots that are required varies depending upon the par for the hole that is currently being played. For example, if the hole is a par three hole, an eagle score is not available and a birdie score is achieved only if the ball is putted into the bonus zone 38 and the putt is the fourth consecutive one in the bonus zone 30*a*. On a par four hole, an eagle score is achieved if a putt into the bonus zone 38 is the fourth or fifth consecutive putt into the bonus zone. A birdie score on a par four hole is achieved if a putt into the bonus zone 38 is the third consecutive putt into the bonus zone. Finally, for a par five hole, an eagle score is achieved by a putt into the bonus zone which is either the third, fourth or fifth consecutive ball putted into the bonus zone. A birdie score on a par five hole is achieved by a putt into the bonus zone 38 which is the second consecutive putt into the bonus zone.

If an eagle shot is achieved, the bonus count is cleared to zero and the player must start over and hit the required consecutive number of bonus shots thereafter in order to achieve a bonus score.

The speed and location of each ball are detected in the manner disclosed in U.S. Pat. No. 5,067,718. In accordance with the present invention, a maximum allowable ball speed is assigned to each of the segments within each target zone. An example of realistic conditions that relate the maximum allowable ball speed to the position of the segment relative to the nearer side edge of each target zone is given in the following Table 2:

TABLE 2

| BALL SPEED (FEET PER SECOND) | RESOLUTION FROM CUP EDGE |
|---|---|
| 1.8 | 1st |
| 2.5 | 2nd |
| 3.0 | 3rd |
| 3.3 | 4th |
| 3.5 | 5th |
| 3.7 | 6th |
| 3.9 | 7th Centerline Par 5 |
| 4.0 | 8th Centerline Par 4 |
| 4.0 | 9th Centerline Par 3 |

If the actual speed of a putted ball exceeds the maximum allowable ball speed assigned to the segment or resolution point that coincides with the center line of the ball, the shot is considered a miss and is assigned a bogey score even though the segment coinciding with the ball center line is within the target area. Thus, a putt that is located near one edge of the target zone is considered to "rim out" if its speed is above the maximum permissible speed for that location within the target area, whereas a putt at the same speed may be considered made if closer to the target zone center.

In operation of the machine 10, the participant putts the ball along the path toward the opening 14 during successive cycles or "holes" of the game. Under suitable program control, the speed and location of the successive putts are detected, and appropriate audio and visual indications are given to indicate the outcome of the putt. At the beginning of each hole, the appropriate LEDs 16 are energized to identify the size and location of the hole. Each time a putted ball 28 enters the opening 14, its location is indicated by the flashing of either three or four adjacent LEDs 16. The machine keeps track of the number of consecutive bonus shots that have been made in order to determine whether a birdie or eagle score is indicated, and the machine also keeps a current running score total and monitors the number of shots that are to the left and right of the target as well as the speed of each shot and the average speed of all of the shots.

Figure 3:
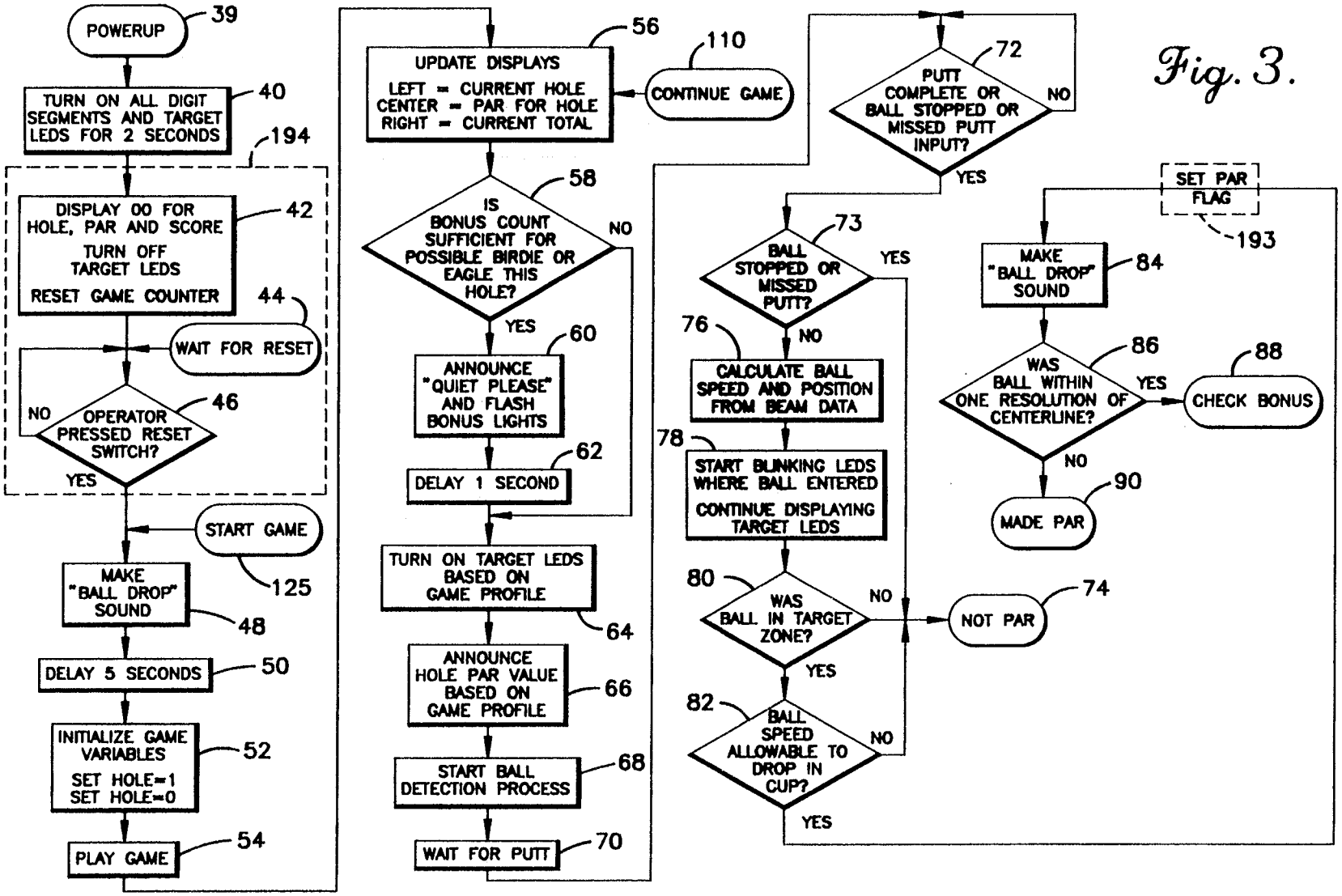
FIG. 3 is a flow chart for the main software routine for the machine.

FIG. 3 depicts in flow diagram form the main game routine. Upon initial application of power as indicated by numeral 39, block 40 is entered to energize for two seconds all of the digital displays 22, 24 and 26 and all of the LEDs 16. At the end of the two second interval, the digits 00 are displayed on each of the displays 22, 24 and 26, the LEDs 16 are deenergized, and the game counter is reset to zero in block 42. The machine then waits for a reset signal as indicated by numeral 44. When it has been determined in block 46 that the reset switch has been pressed, block 48 is entered and a "ball drop" sound is generated to simulate the sound of a golf ball dropping into a cup. Following a five second delay in block 50, the game variables are initialized in block 52.

Play of the game may then begin as indicated by numeral 54. In block 56, the digital displays are updated. The left display 22 is updated to display the number of the current hole (hole number one when the game is beginning). The center display 24 displays the par value for the current hole (as shown in Table 1, the par for hole number one is four). The right hand display 26 displays the current total score for the player (which is zero in the case of a game that is beginning).

After the displays have been updated in block 56, block 58 is entered to determine whether the current bonus count is sufficient for a possible bonus score on the current hole. If it is, block 60 is entered and an audio announcement is made "quiet please" to indicate that an important putt is upcoming. The LED or LEDs representing the bonus zone 38 are also energized in a flashing mode indicating that a potential bonus score putt is upcoming. By indicating both visually and audibly when a bonus score is available, the apparatus simulates a "pressure putt" situation and emphasizes important putts. This increases the realistic nature of play and adds to the appeal to participants.

Following a one second delay in block 62, block 64 is entered and the appropriate LEDs 16 indicative of the size and location of the current hole are energized. For example, with reference to Table 1, hole number one is a par four hole centered at resolution point 30 which is well to the right of center. The LED 16 corresponding to resolution point 30 is energized, along with the four LEDs on each side of it. Block 64 is entered directly from block 58 if a bonus score is unavailable. In block 66, an audio announcement is made indicating the par value for the current hole (e.g., "par four").

The machine is then in condition to detect the speed and position of an incoming ball, as indicated in block 68. As indicated in block 70, the machine then waits for the participant to make a putt toward the target LEDs which are energized above the opening 14. In block 72, a determination is made as to whether a putt has been completed, the ball has stopped after passing through only one beam ("ball stopped") or the putt has not entered the opening 14 at all ("missed putt"). If any of these events has occurred, block 73 is entered to determine whether the ball has stopped short of the second beam or completely missed the opening 14. If either of these events is detected, the putt is not one meriting a par score and block 74 is entered. If neither of these events is detected, block 76 is entered from block 73.

The machine is able to detect automatically when a putt has passed through only the first beam, so the "ball stopped" condition is sensed. However, if the ball fails to enter opening 14 at all, the machine is not able to distinguish between situations where the ball has been putted but is short of opening 14, the ball has been putted but is wide of opening 14, or the ball has not been putted at all. One way of handling this problem is to provide a switch which a participant is to depress if a putt is short and another switch that is to be depressed when a putt is wide. A putt that is short could be assigned a double bogey and a wide putt could be considered a triple bogey. Alternatively, more than one switch could be provided, and the appropriate switch could be depressed depending upon how short a putt is. The score would be increasingly high for putts that are increasingly short. It should be evident that other ways of detecting and scoring putts that are wide and/or short are possible.

In block 76, the ball speed and position are calculated and block 78 is then entered to effect flashing of the three or four LEDs which indicate the ball position. The LEDs 16 which identify the target zone remain energized continuously to distinguish them from the blinking ball location LEDs.

If it is determined in block 80 that the ball was outside of the target zone, the score is not a par score and block 74 is entered. If the ball was within the target zone, block 82 is entered to determine if the ball was within the maximum allowable speed conditions applicable to its location within the target zone (see Table 2). If the applicable speed is exceeded, a par is not warranted and block 74 is entered. If the ball was within the allowable speed conditions, block 84 is entered and an audio "ball drop" sound is generated. If it is determined in block 86 that the ball was in the bonus zone, block 88 is entered to determine whether a bonus score is applicable. If the ball is within the target zone but outside of the bonus zone, a par score is achieved and block 90 is entered.

Figure 4:
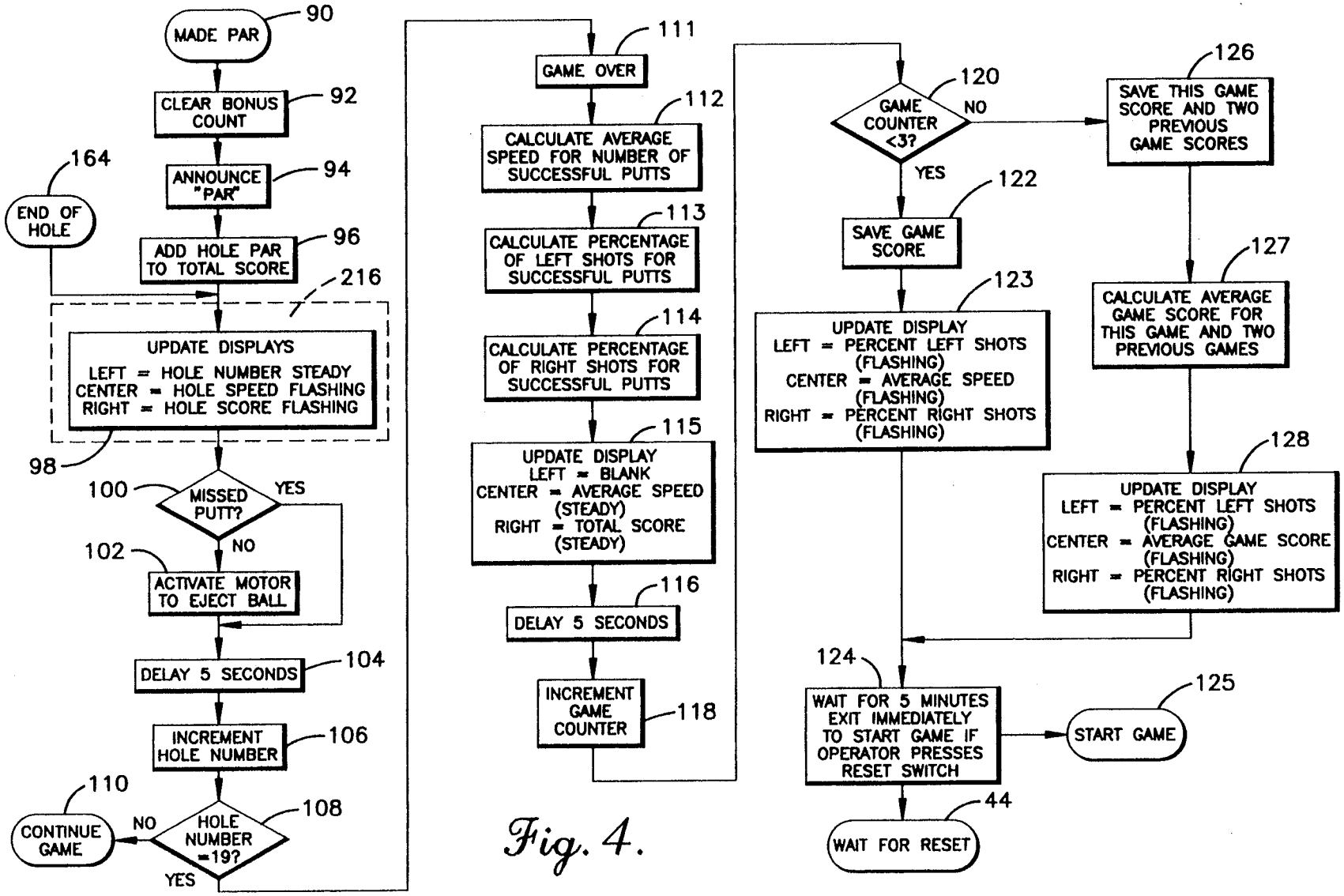
FIG. 4 is a flow chart for the subroutine carried out when a par score is made on the machine.

Referring now to FIG. 4, when a par score has been made outside of the bonus zone, the bonus count is cleared to a zero value in block 92 and an audio announcement of "par" is made in block 94. In block 96, the total score is incremented by the par value of the hole just completed. At the end of the hole, whether a par was made or not, block 98 is entered and the digital displays are updated. On the left hand display 22, the number of the hole just completed is displayed in a steady display. On the center display 24, the speed of the ball for the hole just completed is displayed in a flashing display (in feet per second). On the right hand display 26, the score for the hole just completed is displayed in a flashing mode.

A determination is made in block 100 as to whether or not the immediately previous putt is a "missed putt" (one not entering the opening 14). If it is not, block 102 is entered and the motor of the ball return mechanism is activated to return the ball to the end of the putting path in the manner described in U.S. Pat. No. 5,067,718. Following a delay of five seconds in block 104 to provide time for return of the ball, the hole number is incremented by one in block 106. If the putt was a missed putt, block 102 is bypassed and block 104 is entered directly from putt 100.

Block 108 is entered to determine whether 18 holes have been completed. If the incremented hole number is not equal to 19, the game is continued as indicated in block 110. As shown in FIG. 3, block 56 is entered from block 110 to provide update of the displays in the manner previously described.

Referring back to FIG. 4, if the incremented hole number is equal to 19, a game over block 111 is entered and the average speed for the successful putts is calculated in block 112. In blocks 113 and 114 the percentage of shots that were to the left and to the right of the target area are calculated. Block 115 is then entered to update the displays.

The left hand display 22 is blank at this time. The center display 24 displays the average ball speed for all of the putts. The right hand display 26 displays the total score. This condition of the display panel remains for five seconds as indicated by block 116. At the end of the five second delay period, the game counter is incremented by one in block 118. Block 120 is entered to determine if the game counter value is less than three. If it is, the game score is saved in block 122, and the displays are updated again in block 123. The left hand display 22 displays in a flashing mode the percentage of the shots that were to the left of the target zone. The center display 24 displays in a flashing mode the average speed for all of the balls. The right hand display 26 displays in a flashing mode the percentage of shots that were to the right of the target zone.

A waiting period is initialized in block 124 to allow for a reset signal any time within a five minute period. If the reset switch is pressed at any time within the five minute waiting period, the program immediately exits from the waiting mode and the game is started as indicated by block 125. With reference to FIG. 3, block 48 is entered from the start block 128 and the routine previously described is carried out.

If it is determined in block 120 that the game counter value has reached three, block 126 is entered. The total score of the current game and the two games immediately preceding are saved. In block 127, the average for the three games is calculated. Block 128 is then entered, and the average score which has been calculated is displayed in a flashing mode in the center display. This allows the participant to receive an average of his game scores and is analogous to a "handicap" which is a calculation in the game of golf made to reflect a player's historic scoring record based on recent rounds. Thus, a "handicap" type average score is automatically computed and displayed to enhance the realistic nature of the machine and add to its appeal.

Figure 5:
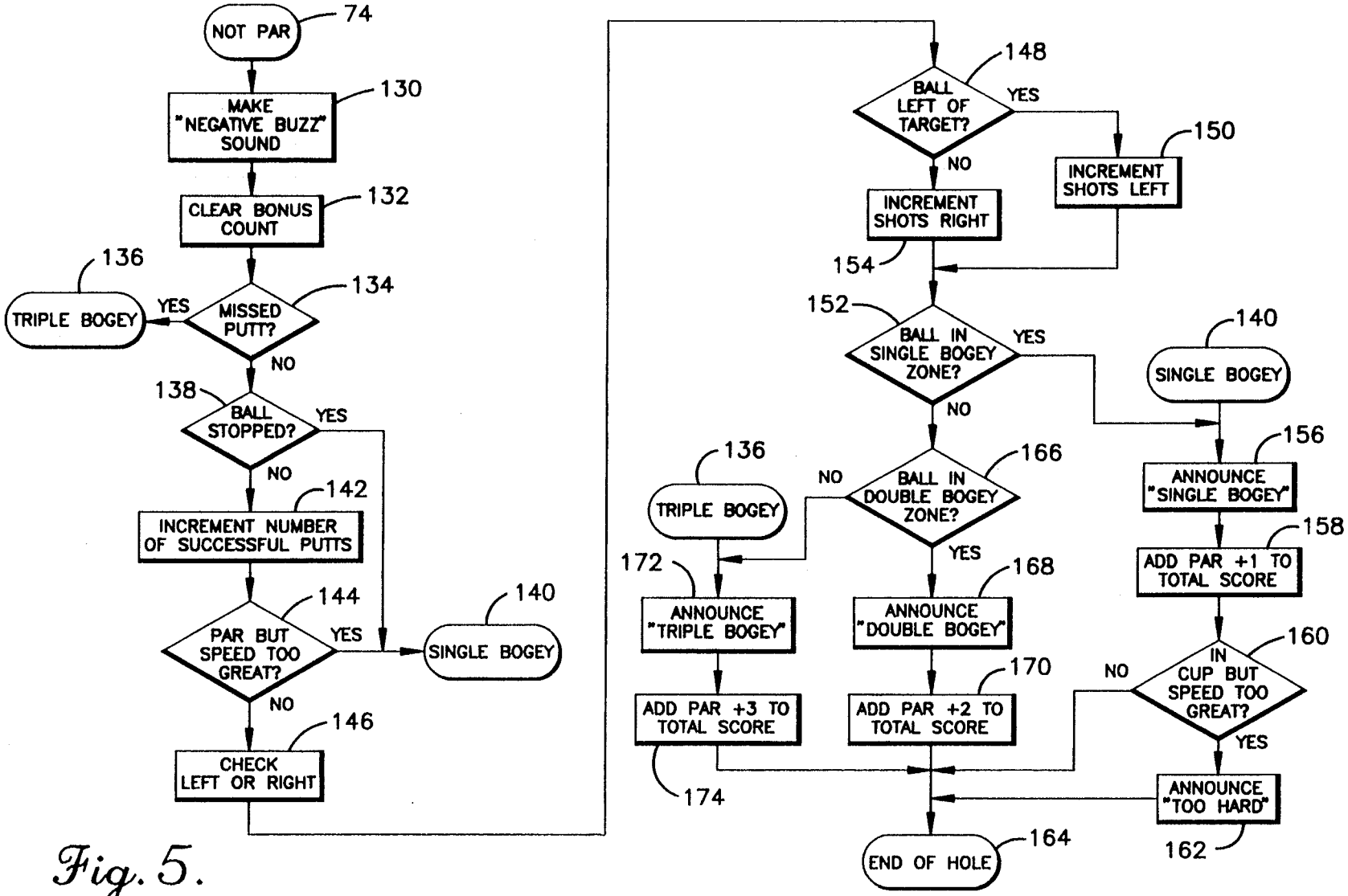
FIG. 5 is a flow chart for the subroutine which is carried out when a par score is not made.

FIG. 5 depicts the routine that is carried out when a putt that is not a par is detected. From block 74, block 130 is entered and an audio "cat call", "raspberry", or other negative sound is generated. The bonus count is cleared to zero in block 132, and block 134 is entered to determine whether the putt missed entering opening 14. If it did, it is considered a triple bogey and block 136 is entered. If the putt is not a missed putt, block 138 is entered to determine whether the ball stopped short of the second beam. If it did, it is considered a bogey and block 140 is entered. If it did not, the number of successful putts is incremented in block 142, and block 144 is entered. If the putt was within the target zone but was too fast according to the maximum allowable speed conditions, it is considered a bogey and block 140 is entered.

If the putt is not within the target zone, a check is made as to whether it was to the left or to the right, as indicated by block 146. In block 148, a determination is made as to whether the ball was to the left of the target. If it was, a number of shots to the left is incremented by one in block 150, and block 152 is then entered. If the putt was to the right of the target, the number of shots to the right is incremented by one in block 154 prior to entering block 152.

Block 156 is entered from the single bogey block 140 and also from block 152 if the ball was in the single bogey zone. A "single bogey" audio announcement is made as indicated by block 156 and the total score is incremented in block 158 by an amount equal to the par value of the hole plus one. In block 160, a determination is made as to whether the ball was in the target zone but too fast to satisfy the speed conditions. If it was, an audio announcement "too hard" is made in block 162 and the end of hole block 164 is then entered. If the ball was not within the target area, block 164 is entered directly from block 160.

If the ball was not in the single bogey zone, block 166 is entered from block 152. If it is determined in block 166 that the ball was in the double bogey zone, an audio "double bogey" announcement is made in block 168. The total score is incremented by the par value of the hole plus two in block 170, and block 164 is then entered.

Block 172 can be entered either from the triple bogey block 136 or from block 166 in the event that the ball is determined not to have been in the double bogey zone. An audio "triple bogey" announcement is made in block 172, and the total score is incremented by the par value of the hole plus three in block 174 prior to entering block 164. With reference to FIG. 4, block 98 is entered from block 164.

Figure 6:
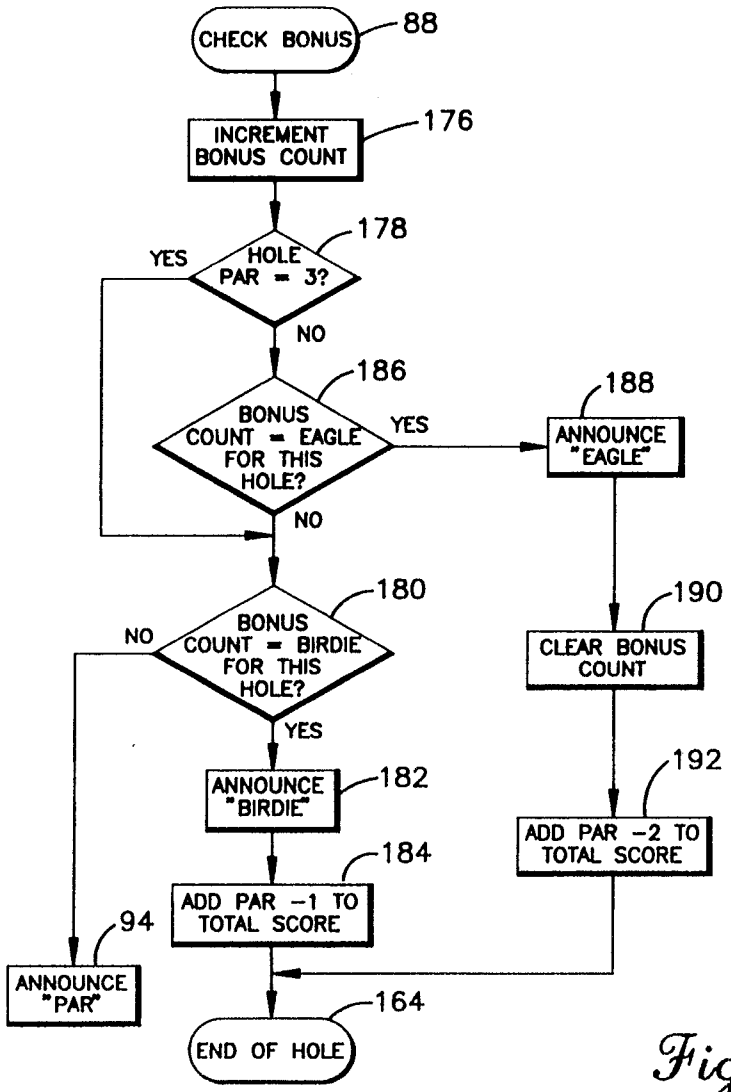
FIG. 6 is a flow chart for the subroutine carried out to determine whether a bonus score is merited.

FIG. 6 depicts in flow chart form the routine for determining whether a bonus score is warranted. From block 88, block 176 is entered to increment the bonus count by one. Block 178 is then entered and a determination is made as to whether the hole is a par three hole. If it is, block 180 is entered from block 178 to determine whether the bonus count is sufficient to warrant a birdie score for the hole. If it is not, the end of hole block 164 is entered immediately. If it is determined in block 180 that a birdie score is indicated, an audio "birdie" announcement is made in block 182. Block 184 is then entered and the total score is incremented by the par value for the hole minus one prior to entering block 164.

If the hole is not a par three hole, block 186 is entered from block 178. If a determination is made in block 186 that the bonus count does not warrant an eagle score for the hole, block 180 is entered from block 186. If the bonus count indicates that an eagle score is warranted, an audio "eagle" announcement is made in block 188. The bonus count is cleared to zero in block 190. The total score is incremented by the par value for the hole minus two in block 192, and block 164 is then entered.

The operation of the machine has been described in connection with a single participant who hits one putt on each hole. It should be understood that multiple player operation is also possible. In this operating mode, the number of consecutive bonus zone putts for each player is monitored separately for a determination of birdie and eagle score applicability. It is also possible for one or more players to have multiple putts on each hole.

It is thus evident that the present invention provides numerous advantageous features that are intended to more closely simulate actual golf putting, including different par values for the different "holes" that are played. A more realistic simulation of actual putting conditions is also provided by taking into account the ball speed compared to the relative location within the target area in determining whether a putt is considered to be a "make" or a "miss". Consistent accuracy is rewarded by awarding birdie and eagle scores based on consistent putting in the bonus zone 38 at the center of the target area. Conversely, by providing the single bogey zones 32 and a multiple bogey zones 34 and 36, shots outside of the target area are penalized with increasing severity as their accuracy decreases. The overall result is that the present invention provides a machine that is able to closely simulate actual putting conditions in order to enhance the appeal of the machine for amusement and to provide more accurate feedback to foster improved putting techniques.

The invention has been described as operating to provide the participants with indications of the speed of each putt and the average speed of all putts. An alternative way of indicating when putts are two hard involves providing an indication of the distance the putt is past the hole. Because this distance is usually more meaningful than a speed indication, the actual game of golf can be more realistically simulated by operating in a "distance past the hole" mode.

In this mode, the central software is modified somewhat. With reference to FIG. 3, the software modifications include the addition of a set par flag block 193 between blocks 82 and 84 and replacement of the steps performed in blocks 42, 44 and 46 with a different routine identified as block 194. In block 193, a par "flag" is set whenever a ball is detected within the target zone and at a speed less than the maximum allowable speed for the ball location within the target zone.

Figure 7:
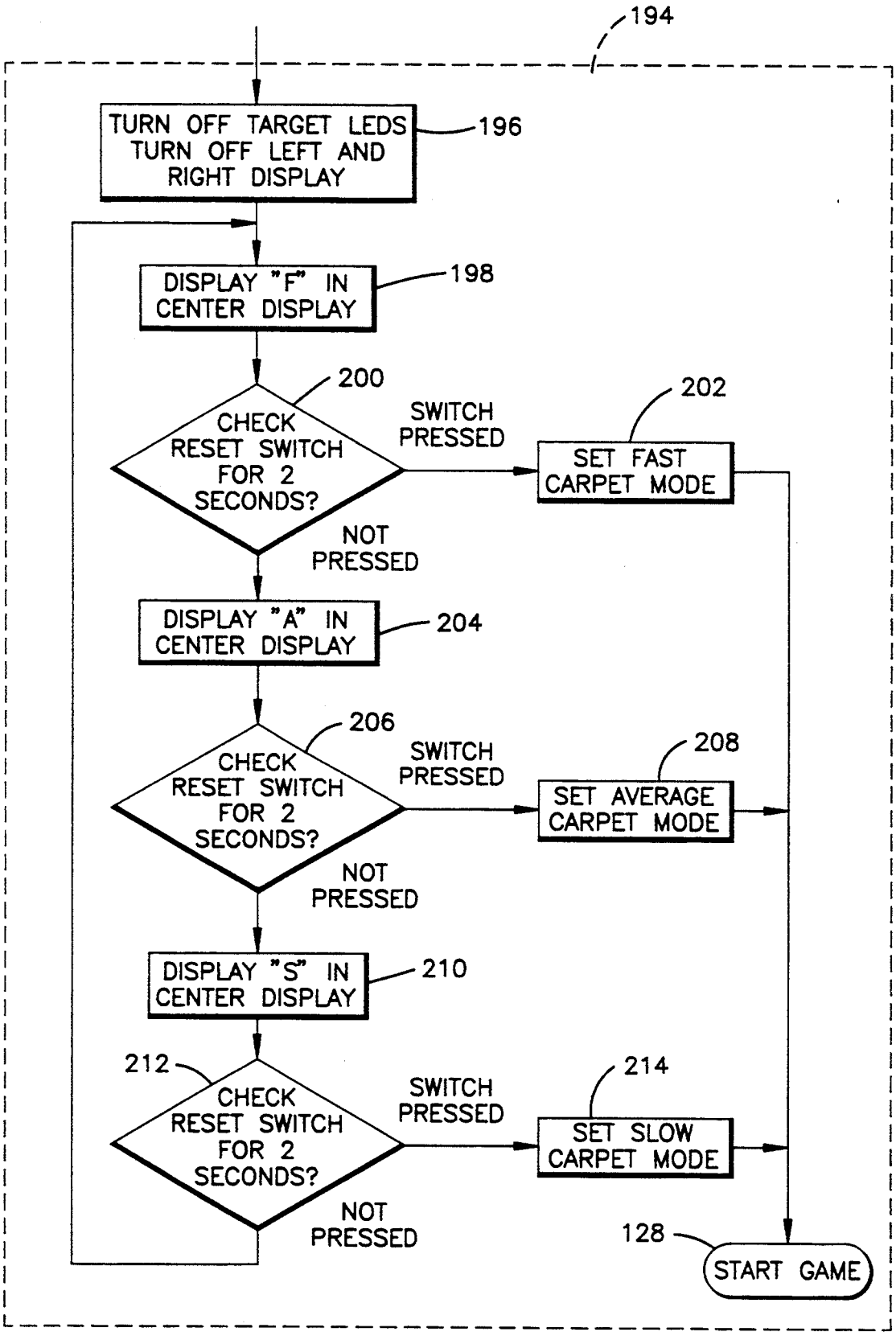
FIG. 7 is a flow chart for an optional routine that is used to enter the speed characteristics of different surfaces in order to allow display of the distance past the hole for missed putts.

The routine represented by block 194 is depicted in FIG. 7. After all digit segments and target LEDS have been energized for two seconds at block 40, block 196 is entered and the target LEDs 16 and the left and right displays 22 and 26 are deenergized. As indicated at block 198, the letter F (representing a relatively fast surface) is displayed in the center display 24. If the surface which underlies the path leading to the opening 14 (typically a carpet or similar surface) is considered by the participant to be a fast surface (one applying a relatively low frictional resistance to a rolling golf ball), the participant should depress the reset switch. In block 200, a determination of whether the reset switch is depressed within two seconds is made. If the participant depresses the reset switch within two seconds of the F being displayed, block 202 is entered and the reset switch input sets the machine in a fast carpet mode. Block 128 is then entered directly from block 202, and the operation continues as described previously.

If the check mode in block 200 is negative, block 204 is entered and the letter A (for average speed) is displayed in the center display 24. A check is made in block 206 to see if the reset switch is depressed within the next two seconds. If it is, block 208 is entered and the machine is placed in an average carpet mode. Block 128 is then entered.

If the reset switch is not detected as being depressed, block 210 is entered from block 206. An S (for slow carpet) is displayed in the center display 24, and block 212 is entered to again check for depression of the reset switch within two seconds. If the switch is depressed, block 214 is entered, and the slow carpet mode is set before block 128 is entered. If the switch is not depressed, the program loops back from block 212 to block 198.

This arrangement allows the participant to enter as input whether the carpet or other surface along which the ball rolls is relatively fast (low frictional resistance to the ball), or relatively slow (high frictional resistance). The control program includes "look up" tables for each carpet speed mode which provide a distance the ball would roll past the hole at the detected ball speed and at the carpet speed mode that is selected. Because the ball decelerates faster on a high friction surface (slow carpet mode), it rolls past the hole a lesser distance than it would on a lower friction surface. By allowing three different carpet speed modes to be entered, the program is able to compensate for the fact that the surfaces leading to the device may be different. Nevertheless, by taking the ball speed and the surface resistance into account, the "look up" tables entered in the machine realistically indicate the distance the ball would roll past the hole for each putt that misses the target area.

Figure 8:
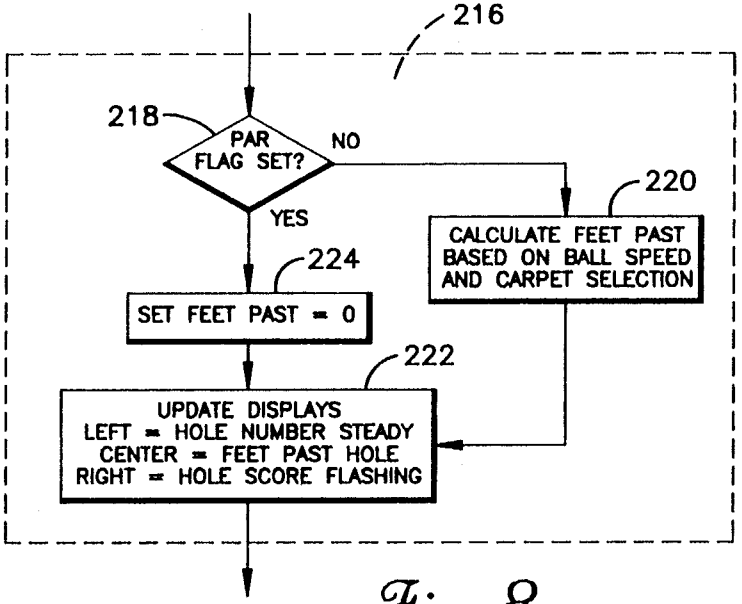
FIG. 8 is a flow chart for an optional routine for determining and displaying the distance past the hole for missed putts.

With reference to FIG. 4, the steps indicated in block 98 are replaced with a routine indicated at 216. As shown in FIG. 8, the routine 216 includes block 218 which checks to see if the par flag has been set in block 193 (FIG. 3). If it has not, block 220 is entered, and the "look up" tables are used to determine the distance past the hole the putt would have reached, based on the ball speed and carpet selection. Block 222 is then entered to update the displays. In the left display 22, the hole number is displayed as a steady display. The center display 24 displays the distance past the hole (in feet). The right display 26 displays the numerical hole score in a flashing mode.

If the par flag is set, block 224 is entered from block 224, and the distance past the hole is set at zero because the putt is considered made. Block 222 is entered from block 224, and the program continues with block 100 (FIG. 4) in the manner already described. However, the calculation in block 114 is of the average feet past the hole rather than the average speed. Likewise, the displays which are updated in block 120 include in the center display 24 a display of the average distance past the hole.

It is contemplated that the participant can select to play either a nine hole round or an eighteen hole round. In addition, a participant can establish a realistic handicap by selecting a mode which averages the total scores from his three most recent eighteen hole rounds and uses this average to compute a handicap in accordance with the normal handicap rules.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. Golf ball putting apparatus comprising:

means for providing a path along which a ball may be putted, said path having a predetermined width dimension;

means for resolving the width dimension of said path into a pre selected number of equally spaced resolution points connected by segments each extending substantially the same distance;

means for defining at one end of the path a target zone for the ball representative of a golf cup and having a width dimension coinciding with a selected number of adjacent segments;

means for defining on opposite sides of said target zone a pair of bogey zones each having a width coinciding with a selected number of adjacent segments;

means for defining adjacent to each bogey zone at least one multiple bogey zone having a width coinciding with a selected number of adjacent segments; and means for sensing the resolution point most closely coinciding with the center of a ball rolling to said one end of the path to determine whether the center of the ball is within the target zone or one of the bogey or multiple bogey zones.

2. Apparatus as set forth in claim 1, including means for varying the number of segments with which the width dimension of the target zone coincides for successive cycles each including a selected number of balls putted to said one end of the path.

3. Apparatus as set forth in claim 2, wherein said varying means is effective to vary the number of segments among a first selected number representative of a par three hole, a second selected number less than said first number and representative of a par four hole, and a third selected number less than said second number and representative of a par five hole.

4. Apparatus as set forth in claim 1, including means for visually indicating when the center of the ball is within the target zone, when the center of the ball is within one of the bogey zones, and when the center of the ball is within a multiple bogey zone.

5. Apparatus as set forth in claim 1, including means for audibly announcing the center of the ball is within the target zone, when the center of the ball is within one of the bogey zones, and when the center of the ball is within a multiple bogey zone.

6. Golf ball putting apparatus comprising:

means for providing a path along which a ball may be putted, said path having a predetermined width dimension;

means for resolving the width dimension of said path into a preselected number of equally spaced resolution points connected by segments each extending substantially the same distance;

means for defining at one end of the path a target zone representative of a golf cup and having a width dimension;

means for varying the number of segments with which the width dimension of the target zone coincides in successive cycles each including a selected number of putted balls, said varying means being effective to vary the number of segments among a first selected number representative of a par three hole, a second selected number less than said first number and representative of a par four hole, and a third selected number less than said second number and representative of a par five hole; and means for sensing the resolution point most closely coinciding with the center of each ball rolling to said one end of the path to determine whether the center of the ball is within the segments coinciding with the target zone then in effect.

7. Apparatus as set forth in claim 6, including means for visually displaying the par value of each hole at the start of each cycle.

8. Apparatus as set forth in claim 6, including means for audibly announcing the par value of each hole at the start of each cycle.

9. Golf ball putting apparatus comprising:

means for providing a path along which a ball may be putted, said path having a predetermined width dimension;

means for resolving the width dimension of said path into a preselected number of equally spaced points of resolution connected by segments each extending substantially the same distance;

means for defining at one end of the path a target zone for the ball representative of a golf cup and having a width dimension coinciding with a selected number of adjacent segments;

means for sensing the resolution point most closely coinciding with the center of a ball rolling to said one end of the path;

means for detecting the speed of each ball at said one end of the path;

means for assigning a maximum allowable ball speed to at least some selected resolution points located within the target zone and contiguous with each outer edge thereof; and means for indicating when the center of the ball coincides most closely with one of said selected resolution points and the ball speed exceeds the maximum allowable ball speed assigned to said one resolution point.

10. Apparatus as set forth in claim 9, wherein the maximum allowable ball speed assigned to said selected resolution points increases with increased distance of the resolution points from the closer outer edge of the target zone.

11. Apparatus as set forth in claim 9, wherein said indicating means includes means for audibly announcing that the ball speed exceeds the maximum allowable ball speed assigned to said one resolution point.

12. Apparatus as set forth in claim 9, including means for providing an indication of a bonus score if a selected number of consecutive balls are centered within selected segments of the target zone.

13. Golf putting apparatus comprising:

means for providing a path along which the ball may be putted, said path having a predetermined width dimension;

means for resolving the width dimension of said path into a preselected number of equally spaced resolution points connected by segments each extending substantially the same distance;

means for defining at one end of the path a target zone for the ball representative of a golf cup and having a width dimension coinciding with a selected number of adjacent segments;

means for defining within said target zone a bonus zone centered in the target zone and having a width dimension coinciding with a predetermined number of segments;

means for sensing the resolution point most closely coinciding with the center of a ball putted to said one end of the path during each successive cycle of the apparatus;

means for providing a score indication when the center of a ball coincides most closely with a resolution point in the target zone; and means for providing a bonus indication when the center of the ball coincides with a segment in the bonus zone during a selected number of consecutive cycles.

14. Apparatus as set forth in claim 13, wherein:

said bonus indication includes one indication representative of a birdie score and another indication representative of an eagle score; and said means for providing a bonus indication is effective to provide said one indication when said selected number of cycles reaches a first predetermined number and to provide said other indication when said selected number of cycles reaches a second predetermined number greater than said first predetermined number.

15. Apparatus as set forth in claim 13, including means for varying the number of segments with which the width dimension of the target zone coincides for successive cycles.

16. Apparatus as set forth in claim 15, wherein:

said bonus indication includes one indication representative of a birdie score and another indication representative of an eagle score; and said means for providing a bonus indication is effective to provide said one indication when said selected number of cycles reaches a first predetermined number and to provide said other indication when said selected number of cycles reaches a second predetermined number greater than said first predetermined number.

17. Apparatus as set forth in claim 16, wherein said first and second predetermined numbers change from cycle to cycle according to the number of segments with which the width dimension of the target zone coincides during the cycle then in effect.

18. Apparatus as set forth in claim 13, including means for audibly announcing the availability of a bonus indication at the start of each cycle that immediately follows the ball having coincided with a segment in the bonus zone during preceding consecutive cycles equal in number to said selected number minus one.

19. Apparatus as set forth in claim 13, including means for visually indicating the availability of a bonus indication at the start of each cycle that immediately follows the ball having coincided with a segment in the bonus zone during preceding consecutive cycles equal in number to said selected number minus one.

20. Golf ball putting apparatus comprising:

means for providing a path along which a ball may be putted, said path having alternative underlying surfaces characterized by different frictional resistances to balls rolling on them;

means for defining at one end of said path a target zone for the ball representative of a golf cup;

means for sensing whether each ball reaching said one end of the path is within or outside of the target zone;

means for detecting the speed of each ball at said one end of the path;

means for receiving an input indicative of the surface that underlies said path;

means for determining from said input and the detected ball speed how far beyond said one end of the path each putted ball that is outside of the target zone would roll before stopping; and means for indicating a distance representing how far beyond said one end of the path each putted ball that is outside of the target zone would roll before stopping.

21. Golf putting apparatus comprising:

means for providing a path along which the ball may be putted, said path having a predetermined width dimension;

means for resolving the width dimension of said path into a preselected number of equally spaced resolution points connected by segments each extending substantially the same distance;

means for defining at one end of the path a target zone for the ball representative of a golf cup and variable in size and location during successive cycles of the apparatus each representative of a golf hole;

means for sensing the resolution point most closely coinciding with the center of a ball putted to said one end of the path during each successive cycle of the apparatus;

means for providing a score for each golf hole dependent at least in part on the location of the ball relative to the target zone then in effect;

means for adding the scores for consecutive holes equal in number to a predetermined number representative of a round of golf; and means for calculating an average round score by averaging the scores for a preselected number of consecutive rounds.

* * * * *